United States Patent [19]

Englert et al.

[11] Patent Number: 5,007,469

[45] Date of Patent: Apr. 16, 1991

[54] PRESSING APPARATUS FOR A PROCESSING MACHINE

[75] Inventors: Heiner Englert, Lauda-Königshofen; Bernhard Martin, Tauberbischofsheim, both of Fed. Rep. of Germany

[73] Assignee: Michael Weinig Aktiengesellschaft, Tauberbischofsheim, Fed. Rep. of Germany

[21] Appl. No.: 418,022

[22] Filed: Oct. 6, 1989

[30] Foreign Application Priority Data

Oct. 7, 1988 [DE] Fed. Rep. of Germany ... 8812623[U]

[51] Int. Cl.[5] ..... B27G 19/00

[52] U.S. Cl. ..... 144/252 R; 144/136 R; 144/242 A

[58] Field of Search ..... 144/114 R, 117 R, 117 B, 144/134 R, 136 R, 242 B, 243, 250 A, 252 R, 252 P

[56] References Cited

U.S. PATENT DOCUMENTS

| | | | |
|---|---|---|---|
| 2,349,162 | 5/1944 | Gaskell et al. | 144/252 R |
| 2,577,975 | 12/1951 | Moore | 144/252 R |
| 3,367,377 | 2/1968 | Mitten | 144/252 R |

*Primary Examiner*—W. Donald Bray
*Attorney, Agent, or Firm*—Robert W. Becker & Associates

[57] ABSTRACT

A pressing apparatus for a processing machine, especially a woodworking machine, preferably a grooving machine, including at least one adjustable pressing element that is provided for the workpiece which is to be processed and that is associated with a processing tool, preferably a cutter head. The pressing element is adjustable relative to the processing tool at an angle to the direction of transport of the workpieces through the machine.

20 Claims, 2 Drawing Sheets

PRESSING APPARATUS FOR A PROCESSING MACHINE

BACKGROUND OF THE INVENTION

The present invention relates to a pressing apparatus for a processing machine, preferably a woodworking machine, especially a grooving machine, including at least one adjustable pressing element that is provided for the workpiece which is to be processed and that is associated with a processing tool, preferably a cutter head With woodworking machines, a pressing element in the form of a pressing shoe is disposed upstream of the respective processing tool as viewed in the direction of transport of the workpieces that are to be processed. As the workpieces that are to be processed are transported through the machine, the pressing shoe presses the workpieces against an appropriate guide means or support. The pressing element must be disposed a specific distance from the path of the processing tool in order to be able to exert an optimum effect If the working or processing tool is replaced by another processing tool that has a different path diameter, it is necessary to adjust the pressing element via a complicated process. In so doing, it is necessary to readjust the pressing element not only in the horizontal direction but also in the vertical direction. This involved adjustment is not only complicated and difficult, but it is also time consuming.

It is therefore an object of the present invention to embody a pressing apparatus of the aforementioned general type in such a way that the pressing element can be easily adjusted relative to the processing tool in a very short period of time.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The pressing apparatus of the present invention is characterized primarily in that the pressing element is adjustable relative to the processing tool at an angle to the direction of transport of the workpieces through the machine.

With the inventive pressing apparatus, it is possible to simultaneously horizontally and vertically adjust the pressing element in only a single adjustment procedure, because the pressing element is adjusted relative to the processing tool at an angle to the direction of transport of the workpieces. The adjustment direction or plane of the pressing element is such that for processing tools having different path diameters, the pressing element is respectively brought into an at least nearly optimum position relative to the processing tool. The adjustment of the pressing element can be carried out easily, and above all can be carried out very rapidly.

Further specific features of the present invention will be described in detail subsequently.

DESCRIPTION OF PREFERRED EMBODIMENTS

Figure 1:
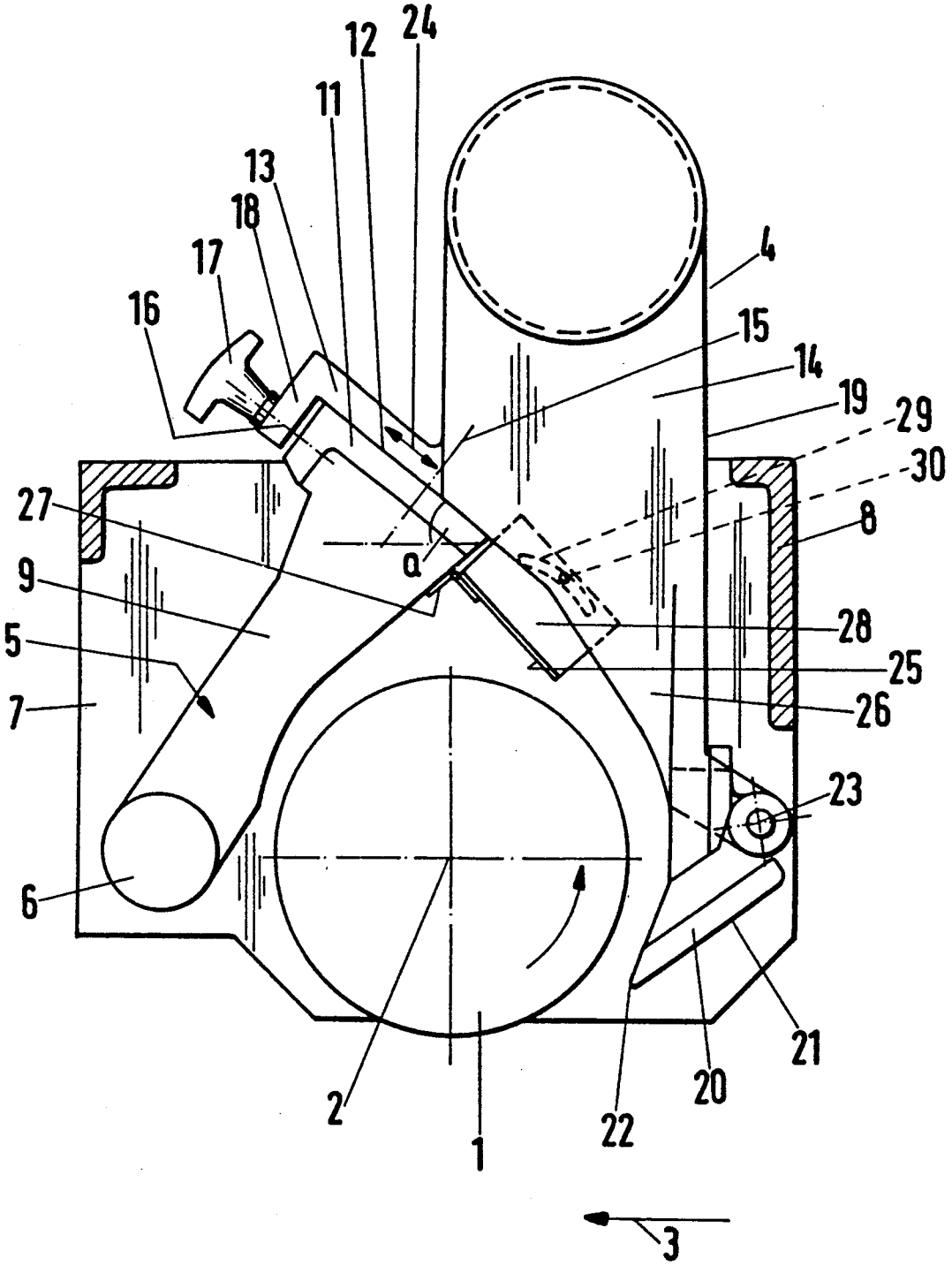
FIG. 1 is a partially cross-sectioned side view of one exemplary embodiment of the inventive pressing apparatus for a woodworking machine.

Referring now to the drawings in detail, the illustrated pressing apparatus is provided for a woodworking machine, preferably a grooving machine, and is disposed in the region of the working tools of this woodworking machine. In FIG. 1, the woodworking tool is in the form of a cutter head 1 that is rotatable driven about a horizontal axis 2. Along its periphery, the cutter head 1 is provided with non-illustrated blades with which pieces of wood that are guided past below the cutter head in the direction of the arrow 3 are worked. The turnings or shavings that are produced while working the pieces of wood are removed by the suction hood 4, which covers the cutter head. The suction hood 4 is secured to a carrier 5, which is mounted on a pivot shaft 6, which in turn is pivotably mounted in side walls 7 of a cover means 8. The carrier 5 has a pronged configuration, and is provided with two legs 9 and 10 via which it is seated on the pivot shaft 6. The two legs 9, 10 are interconnected via a cross or support member 11, the upper side 12 of which (FIG. 1) is remote from the pivot shaft 6 and forms for the suction hood 4 an abutment and adjustment surface that includes an adjustment part 13 that rests upon the upper side 12 of the cross member 11 and projects at an angle from a wall of the suction channel 14. Both the adjustment part 13 and the cross member 11 are preferably embodied in a platelike manner. As merely schematically indicated in FIG. 1, the adjustment part 13 is secured to the cross member 11 by screws 15. Non-illustrated slots are provided in the adjustment part 13 for such screws 15; these slots extend perpendicular to the longitudinal direction of the adjustment part 13 or cross member 11, i.e. to the axis of rotation 2 of the cutter head 1. These slots are provided in order to be able to adjust the suction hood 4, after the screws 15 have been loosened, to adapt the carrier 5 to cutter heads 1 having different diameters. For this adjustment process, an adjustment spindle 16, which can be turned by a knob 17, is mounted on the adjustment part 13. The adjustment spindle 16 extends through a support element 18 that projects at right angles from the adjustment part 13; the adjustment spindle 16 is held in the cross member 11.

Mounted on the rear wall 19 of the suction hood 4 as viewed in the direction of transport 3 is a pressing element 20 in the form of a pressing shoe. This pressing shoe has a pressing surface 21 that is inclined downwardly and toward the front as viewed in the direction of transport 3. During transport of the pieces of wood that are to be worked in the direction of transport 3, these pieces of wood come into contact with this pressing surface 21 upstream of the cutter head 1, and during the working are pressed against the non-illustrated transport track or belt of the woodworking machine. On its downstream side, as viewed in the direction of transport 3 of the pieces of wood, the pressing element 20 is provided with a tip or edge 22 that in a known manner is spaced a prescribed distance from the path of the cutter head 1. The pressing element 20 is mounted on the suction hood 4 in such a way that it is pivotable to a limited extent about a shaft or axis 23. FIG. 1 shows the pressing element 20 in its end position, in which it is pressed by a non-illustrated spring. The pressing element 20 has an only relatively slight pivot path in order not to adversely affect the pressing action upon the pieces of wood that are to be worked. By means of the spring, the pressing element 20 is loaded in a direction toward the cutter head 1. If the wood that is to be worked varies greatly in thickness, the pressing element 20 can be pivoted slightly relative to the suction hood 4 against the force of the spring. It has been shown that this damping mechanism reliably prevents the entire suction hood 4 from vibrating. The suction hood 4 along with the carrier 5 itself are similarly spring-loaded in a known manner, so that these components can similarly pivot away when the wood that is to be worked varies greatly in thickness. The spring force of the suction hood and the carrier is, however, considerably greater than the spring force of the pressing element 20. As a result, where the differences in the thickness of the wood that is to be worked are small, merely the pressing element 20 is pivoted away without this having any effect upon the suction hood 4. As a consequence of this construction, a considerable reduction in noise is achieved during working of the pieces of wood, because the suction hood 4 along with the carrier 5 remain quiet, with at most the pressing element 20 moving relative to the suction hood 4.

In order to achieve an optimum effect, the edge 22 of the pressing element 20 must be set relative to the path of the cutter head 1 in conformity with the diameter of the path of the cutter head that is being utilized. In order to make this adjustment possible, it is merely necessary to loosen the screws 15 and to then, via the adjustment spindle 16, adjust the suction hood 4, along with the pressing element 20 that is mounted thereon, relative to the carrier 5. In so doing, the upper side 12 of the cross member 11 of the carrier 5 permits a precise and exact adjustment of the pressing element 20.

The upper side 12 of the cross member 11 is inclined at such an angle to the horizontal that when the suction hood 4 is shifted in the direction of the double arrow 24, the edge 22 of the pressing element 20 is shifted not only horizontally, but simultaneously also vertically relative to the cutter head 1. Depending upon the diameter of the path of the cutter head, the edge 22 will have to be adjusted not only in a horizontal direction, but also in a vertical direction. However, as a consequence of the inclined position of the upper side 12, only a single adjustment process is necessary in order to effect these two adjustments. In order to achieve an optimum adjustment of the edge 22 of the pressing element 20, the upper side 12 of the cross member 11 is disposed at an angle $\alpha$ of approximately 40° to 50° relative to the horizontal (FIG. 1). If the upper side 12 is inclined relative to the horizontal within this angular range, the edge 22 of the pressing element 20 can, in a single adjustment process, be optimally adjusted into a respective position for all different path diameters. Since the user of the suction hood thus has only to carry out a single adjustment process via the adjustment spindle 16, he can set the pressing element 20 to the respectively required position without difficulty.

Figure 2:
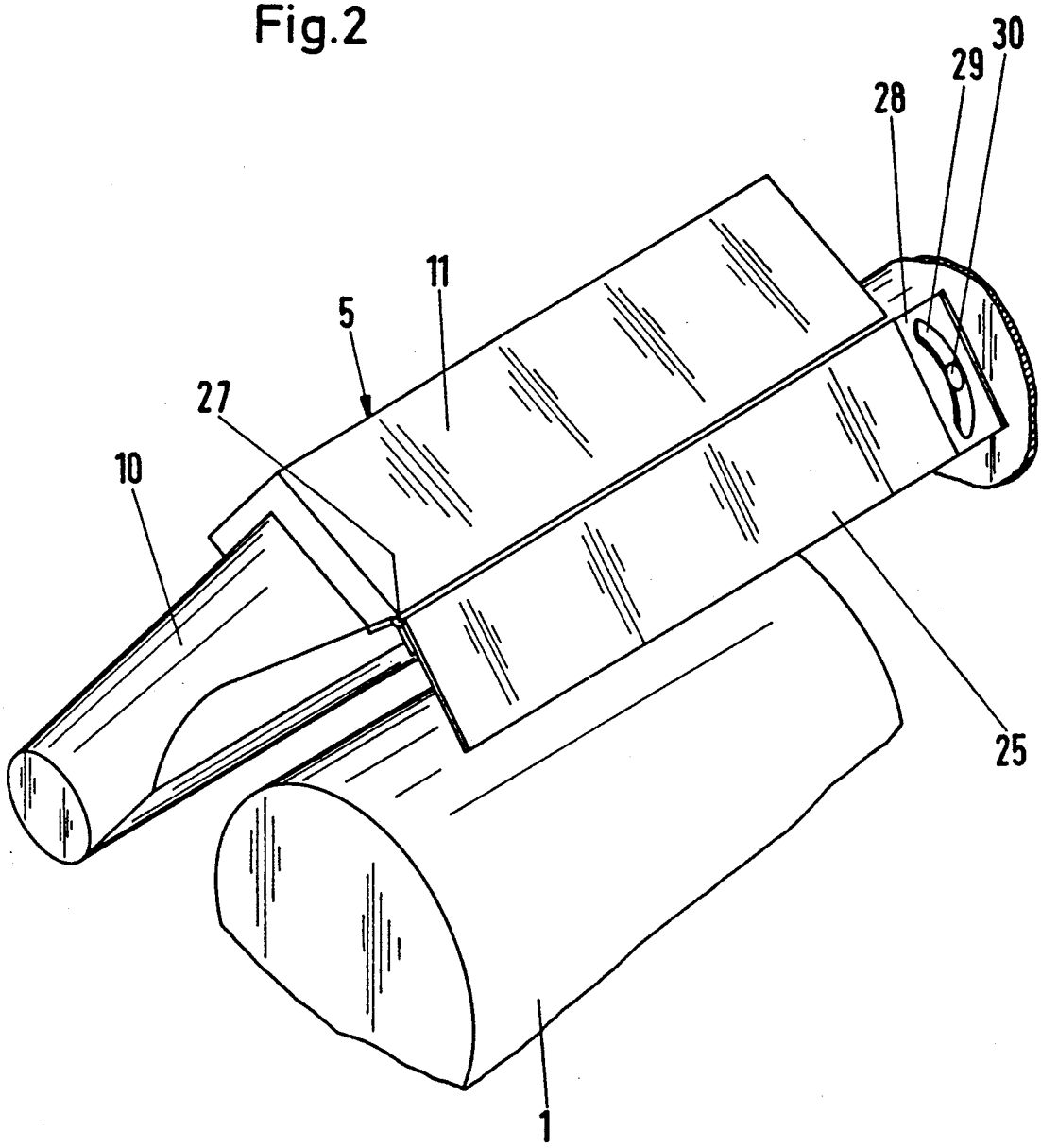
FIG. 2 is a perspective view of a portion of the pressing apparatus of FIG. 1.

Different amounts of shavings are produced during working of the wood pieces in conformity with the path diameter, i.e. the size of the cutter head 1. In order to be able to reliably suction-off these different quantities of shavings, the suction hood 4 is provided with a guide or deflector plate 25 that is adjustable as a function of the path diameter. The deflector plate 25 for the shavings is spaced from the wall 19 of the suction channel 14 and together therewith delimits the introduction opening 26 through which the shavings that result during the woodworking operation pass into the suction channel 14. The deflector plate 25 is connected to the carrier 5 via a hinge 27. As shown in FIG. 2, one end of the deflector plate 25 is bent upwardly away from the cutter head 1. This bent-up end 28 forms a guide plate that is provided with curved track means 29 with which is associated a control pin 30. The curved track means 29 is embodied as a curved, elongated opening in the guide plate 28. The control pin 30 is provided on the suction hood 4 and engages in the curved track means 29. The control pin 30 and the curved track means 29 together form an automatic control for the deflector plate 25. If the suction hood 4 along with the pressing element 20 are adjusted relative to the carrier 5 in the aforementioned manner via the adjustment spindle 16, this automatic control 29, 30 also simultaneously adjusts the deflector plate 25. The curved track means 29 is disposed in such a way that the deflector plate 25 is pivoted away from the axis 2 of the cutter head 1 as soon as the pressing element 20 is moved away from the cutter head 1. Conversely, the deflector plate 25 is pivoted toward the cutter head 1 when the pressing element 20 is set closer to the axis 2 of the cutter head. In this way, the position of the deflector plate 25 is automatically coupled with the position of the pressing element 20 relative to the cutter head 1, so that the introduction opening 26 into the suction channel 14 always has the optimum cross-sectional area. Thus, by adjusting the suction hood 4, not only is the pressing element 20 optimally set to the respective path diameter of the cutter head 1, but at the same time the deflector plate 25 is also adjusted into the respectively optimum position. Consequently, separate adjustments for the deflector plate are not required.

The previously described suction hood 4 permits an extremely straightforward and yet very reliable adjustment for adaptation to the respective path diameter of the cutter head 1, while at the same time assuring that the deflector plate 25 also assumes its required optimum position during this adjustment. Fine adjustments are thereby eliminated.

The present invention is, of course, in no way restricted to the specific disclosure of the specification and drawings, but also encompasses any modifications within the scope of the appended claims.

What I claim is:

1. In a pressing apparatus for a processing machine, including at least one adjustable pressing element that is provided for a workpiece which is to be processed and that is associated with a processing tool, the improvement comprising:

means for adjusting said pressing element relative to said processing tool at an angle to a direction of transport of said workpiece through said machine.

2. A pressing apparatus according to claim 1, which is provided with a support member that has an adjustment surface that is inclined at an angle relative to a horizontal plane that is essentially parallel to an axis of rotation of said processing tool, with said pressing element being adjustable along said adjustment surface via said adjusting means.

3. A pressing apparatus according to claim 2, in which said pressing element is adjustable at an angle of between approximately 40° and 50° to said direction of transport of said workpiece.

4. A pressing apparatus according to claim 3, in which said adjustment surface is inclined relative to said horizontal plane at said angle of between approximately 40° and 50°.

5. A pressing apparatus according to claim 2, which is disposed on a suction unit that has at least one suction hood and a carrier for said suction hood, with said support member with its adjustment surface being provided on said carrier.

6. A pressing apparatus according to claim 5, in which said pressing element is connected to said suction hood.

7. A pressing apparatus according to claim 6, in which said suction hood is adjustable relative to said carrier to effect said adjustment of said pressing element.

8. A pressing apparatus according to claim 7, in which said suction hood is adjustable along said adjustment surface of said support member of said carrier.

9. A pressing apparatus according to claim 8, in which said pressing element is mounted on said suction hood in such a way as to be resilient to a limited extent relative to said suction hood.

10. A pressing apparatus according to claim 8, in which said carrier, with said suction hood and said pressing element, are pivotable in a direction transverse to said axis of rotation of said processing tool.

11. A pressing apparatus according to claim 10, in which said suction hood includes a suction channel having an introduction opening for receiving shavings produced by said processing tool; and which includes a deflector plate for said shavings, with said deflector plate delimiting said introduction opening and being adjustable transverse to said axis of rotation of said processing tool for the purpose of changing the cross-sectional area of said introduction opening.

12. A pressing apparatus according to claim 11, in which said deflector plate is pivotable.

13. A pressing apparatus according to claim 12, in which said deflector plate is hinged to said carrier.

14. A pressing apparatus according to claim 13, in which said deflector plate is also connected to said suction hood via automatic guide means.

15. A pressing apparatus according to claim 14, in which said deflector plate is positively coupled with said suction hood via said carrier.

16. A pressing apparatus according to claim 14, in which said guide means comprises curved track means and an associated follower pin.

17. A pressing apparatus according to claim 16, in which said curved track means is an elongated curved opening.

18. A pressing apparatus according to claim 17, in which said curved opening is provided in said deflector plate.

19. A pressing apparatus according to claim 18, in which said deflector plate is provided with an angled-off guide plate in which said curved opening is provided.

20. A pressing apparatus according to claim 18, in which said follower pin is provided on said suction hood.

* * * * *